US005452822A

United States Patent [19]

Haymond

[11] Patent Number: 5,452,822

[45] Date of Patent: Sep. 26, 1995

[54] GUMBALL MACHINE

[76] Inventor: Dave E. Haymond, 628 S. Alba Cir., Mesa, Ariz. 85204

[21] Appl. No.: 231,700

[22] Filed: Apr. 25, 1994

[51] Int. Cl.[6] ..... G07F 11/00

[52] U.S. Cl. ..... 221/155; 221/196; 221/284; 221/24

[58] Field of Search ..... 221/24, 155, 282, 221/284, 194, 195, 196, 265

[56] References Cited

U.S. PATENT DOCUMENTS

| | | | |
|---|---|---|---|
| D. 333,681 | 3/1993 | Stern . | |
| 1,711,654 | 5/1929 | Redlinger . | |
| 1,725,965 | 8/1929 | Ormiston | 221/24 |
| 2,193,211 | 3/1940 | Taylor | 221/155 |
| 2,606,088 | 8/1952 | Leaf . | |
| 2,614,673 | 10/1952 | Obodzinski | 221/265 |
| 2,759,632 | 8/1956 | Ussery et al. | 221/155 |
| 2,772,811 | 12/1956 | Schaef | 221/155 |
| 2,843,985 | 7/1958 | Ritzenberg | 221/196 |
| 2,880,906 | 4/1959 | Probasco | 221/265 |
| 3,018,148 | 1/1962 | Probasco | 221/282 |
| 3,036,732 | 5/1962 | Schaef . | |
| 3,077,254 | 2/1963 | Goldfarb | 221/155 |
| 3,081,908 | 3/1963 | Siegfried . | |
| 3,375,912 | 4/1968 | Weitzman | 221/155 |
| 3,825,265 | 7/1974 | Pitkanen et al. . | |
| 4,560,086 | 12/1985 | Stol | 221/24 |
| 4,667,848 | 5/1987 | Gold | 221/155 |
| 5,004,122 | 4/1991 | Poynter | 221/155 |
| 5,261,564 | 11/1993 | Yelvington . | |

*Primary Examiner*—H. Grant Skaggs
*Attorney, Agent, or Firm*—Tod R. Nissle

[57] ABSTRACT

A gumball machine attracts and entertains users by enabling a user, after he purchases a gumball from the machine, to visually observe the gumball as it travels from the storage area of the gumball machine to the dispenser where the user removes the gumball from the machine.

12 Claims, 7 Drawing Sheets

GUMBALL MACHINE

This invention relates to gumball machines.

More particularly, the invention relates to a gumball machine which attracts and entertains users by enabling a user, after he purchases a gumball from the machine, to visually observe the gumball as it travels from the storage area of the gumball machine to the dispenser where the user removes the gumball from the machine.

In a further respect, the invention relates to a gumball machine which causes a gumball to move in alternating opposing paths of travel after the gumball has been purchased and is being dispensed by the machine.

In another respect, the invention relates to a gumball machine which enables a user to identify the color of a gumball before the gumball is dispensed into the hand of the user.

In still a further respect, the invention relates to a gumball machine which alters the rate of descent of a gumball after the gumball has been purchased and is being delivered to the base of the machine for dispensation to a user.

Gumball machines are well known in the art and include a storage container, a coin actuated dispensing mechanism, and a cup into which gumballs are dispensed for removal by a customer. While gumball machines can provide a steady source of revenue, the sales of gumballs by such machines are limited, in part because they do not readily attract potential customers.

Accordingly, it would be highly desirable to provide an improved gumball machine which would readily visually attract potential customers, both to increase the revenue generated by such machines and to entertain.

It would also be highly desirable to provide an improved gumball machine which, in use, placed a customer in an improved state of mind for purchasing products from retail store outlets located nearby or adjacent the gumball machine.

Therefore, it is a principal object of the invention to provide an improved gumball machine.

A further object of the invention is to provide an improved gumball machine which is significantly more successful in visually attracting potential customers.

Another object of the invention is to provide an improved gumball machine which increases the likelihood that shoppers utilizing the machine will purchase additional goods from surrounding retail outlets.

Still a further object of the invention is to provide a gumball machine which enables youngsters to utilize the machine as a game for identifying the color of objects while the objects are moving through the machine to be dispensed.

These and other, further and more specific objects and advantages of the invention will be apparent to those skilled in the art from the following detailed description thereof, taken in conjunction with the drawings, in which.

Briefly, in accordance with my invention, I provide an improved gumball machine. The machine includes a container for storing gumballs; a base; a transport system intermediate the base and the container for permitting a gumball from the container to roll under gravity along a path from the container toward the base, the transport system having an upper end and a lower end; a transport housing enclosing the transport means and permitting a user to visually observe at least a portion of the travel of a gumball while the gumball rolls along the path from the container toward the base; and, a dispensing mechanism operatively associated with the transport system and actuable to deposit a gumball from the container in said upper end of the transport system to roll along the path under gravity toward the base.

In another embodiment of the invention, I provide an improved gumball machine including a container for storing gumballs; a base; a transport system intermediate the base and the container for permitting a gumball from the container to move under gravity from the container toward the base along a path of travel in alternating opposing directions, the transport system having an upper end and a lower end and permitting a user to visually observe at least a portion of the movement of a gumball from the container toward the base along the path of travel; and, a dispensing mechanism operatively associated with the transport means and actuable to deposit a gumball from the container in the upper end of the transport means to move under gravity toward the base along the path of travel.

In a further embodiment of the invention, I provide an improved gumball machine including a container for storing gumballs; a base; a transport system intermediate the base and the container for permitting a gumball from the container to travel under gravity from the container toward the base, the transport means having an upper end and a lower end and permitting a user to visually observe at least a portion of the travel of a gumball from the container toward the base; and, a dispensing mechanism operatively associated with the transport means and actuable to deposit a gumball from the container in the upper end of the transport means to travel under gravity toward the base.

In still another embodiment of the invention, I provide an improved gumball machine including a container for storing a plurality of different colored gumballs; a base; transport means intermediate the base and the container for permitting a gumball from the container to travel under gravity from the container toward the base, the transport means having an upper end and a lower end and permitting a user to determine the color of a gumball traveling in the transport means; and, a dispensing mechanism operatively associated with he transport means and actuable to deposit a gumball from the container in the upper end of the transport means to travel under gravity toward the base.

Figure 1:
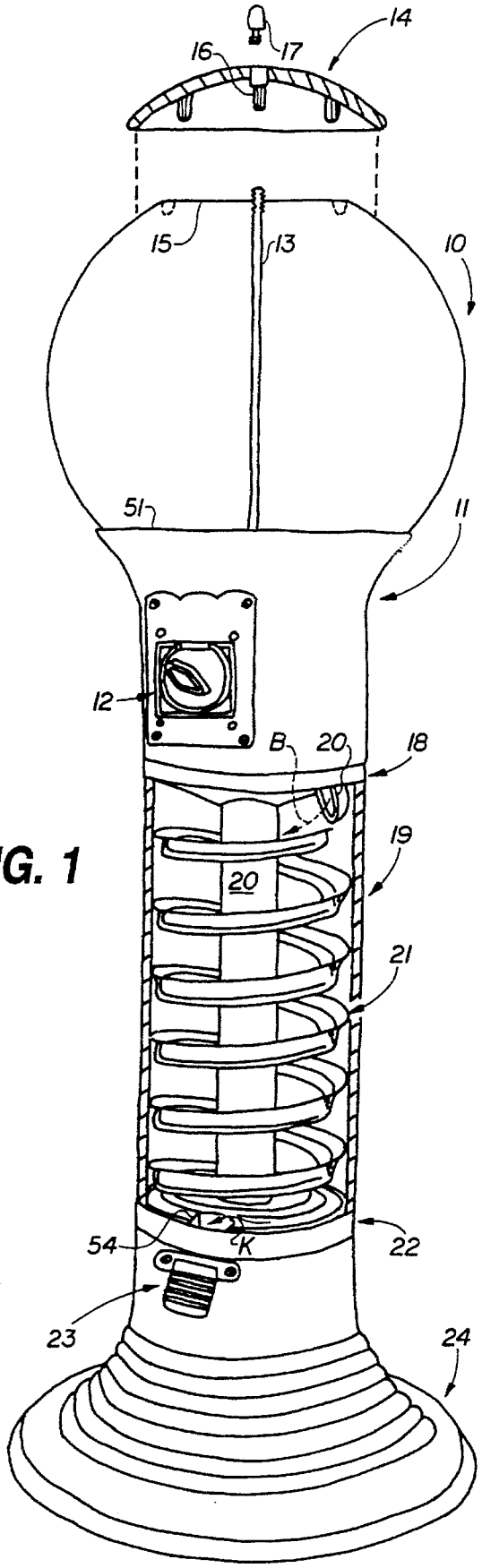
FIG. 1 is a front elevation view illustrating a gumball machine constructed in accordance with the principles of the invention.

Turning now to the drawings, which describe the presently preferred embodiments of the invention for the purpose of illustrating the practice thereof, and not by way of limitation of the scope of the invention, and in which like reference characters refer to corresponding elements throughout the several views, FIG. 1 illustrates a gumball machine including a cover 14, spherical container 10 in which gumballs are stored, neck 11, manually operated coin actuated gumball dispensing mechanism 12 mounted in neck 11, upper cylindrical band 18, elongate hollow cylindrical body 19, hollow cylindrical post 20, spiral track 21, lower cylindrical band 22, base 24, and gumball dispensing cup assembly 23 mounted in base 24.

Figure 2:
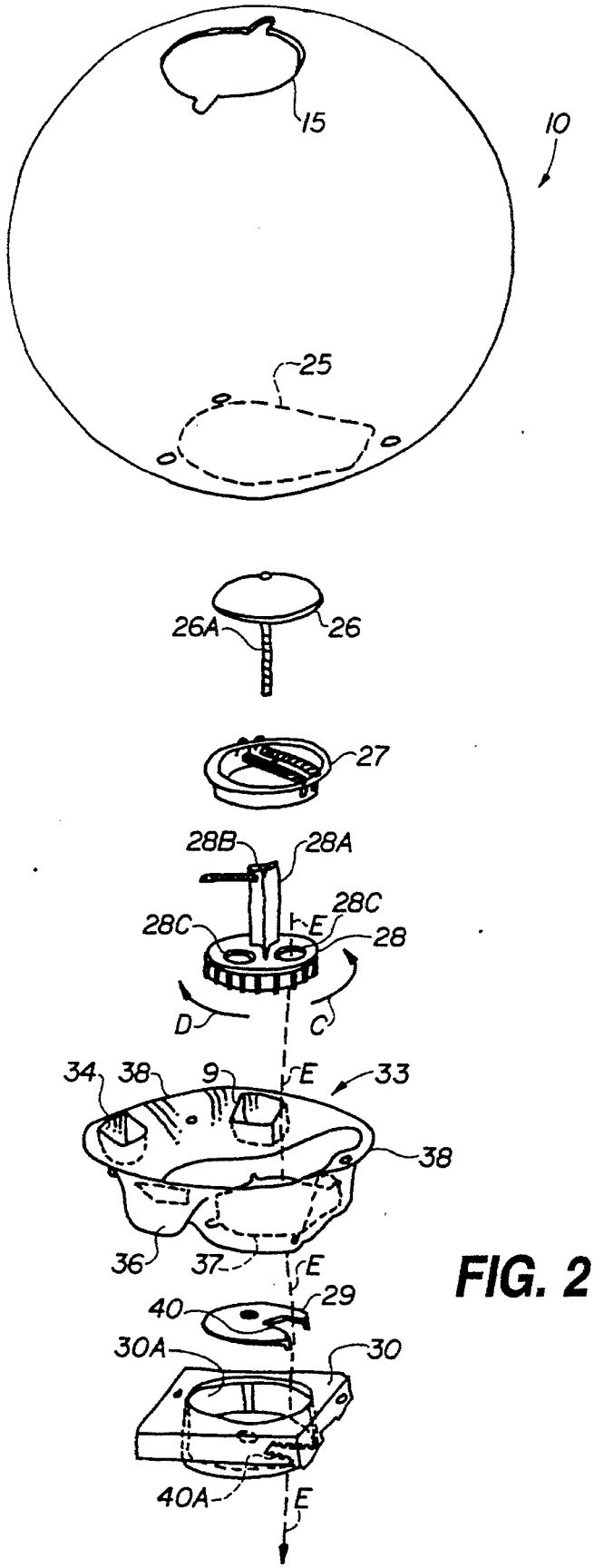
FIG. 2 is an exploded view of certain illustrating the components of the gumball machine of FIG. 1.
Figure 3:
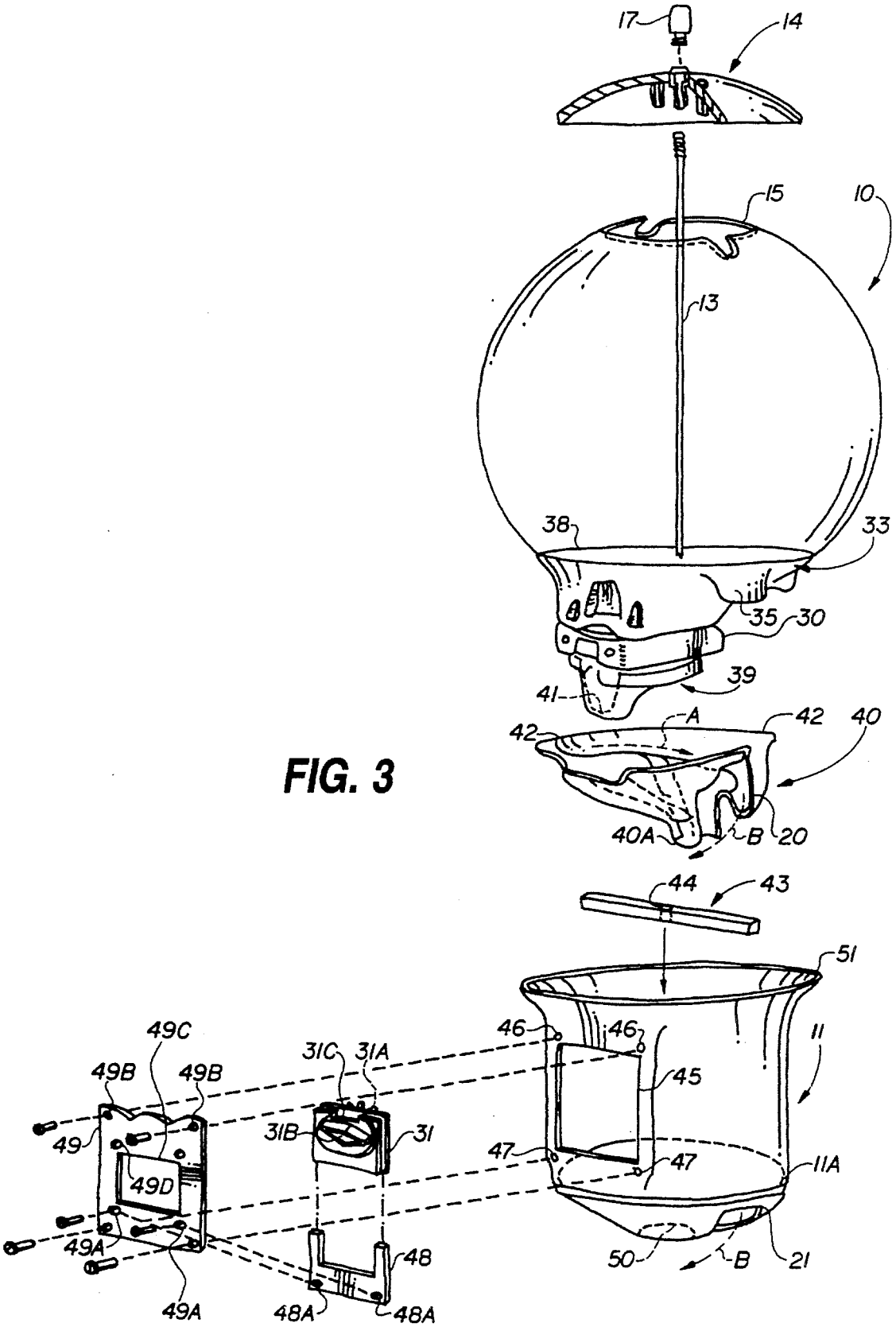
FIG. 3 is an exploded assembly view illustrating certain of the components of FIG. 2 assembled along with additional components of the gumball machine of FIG. 1.
Figure 4:
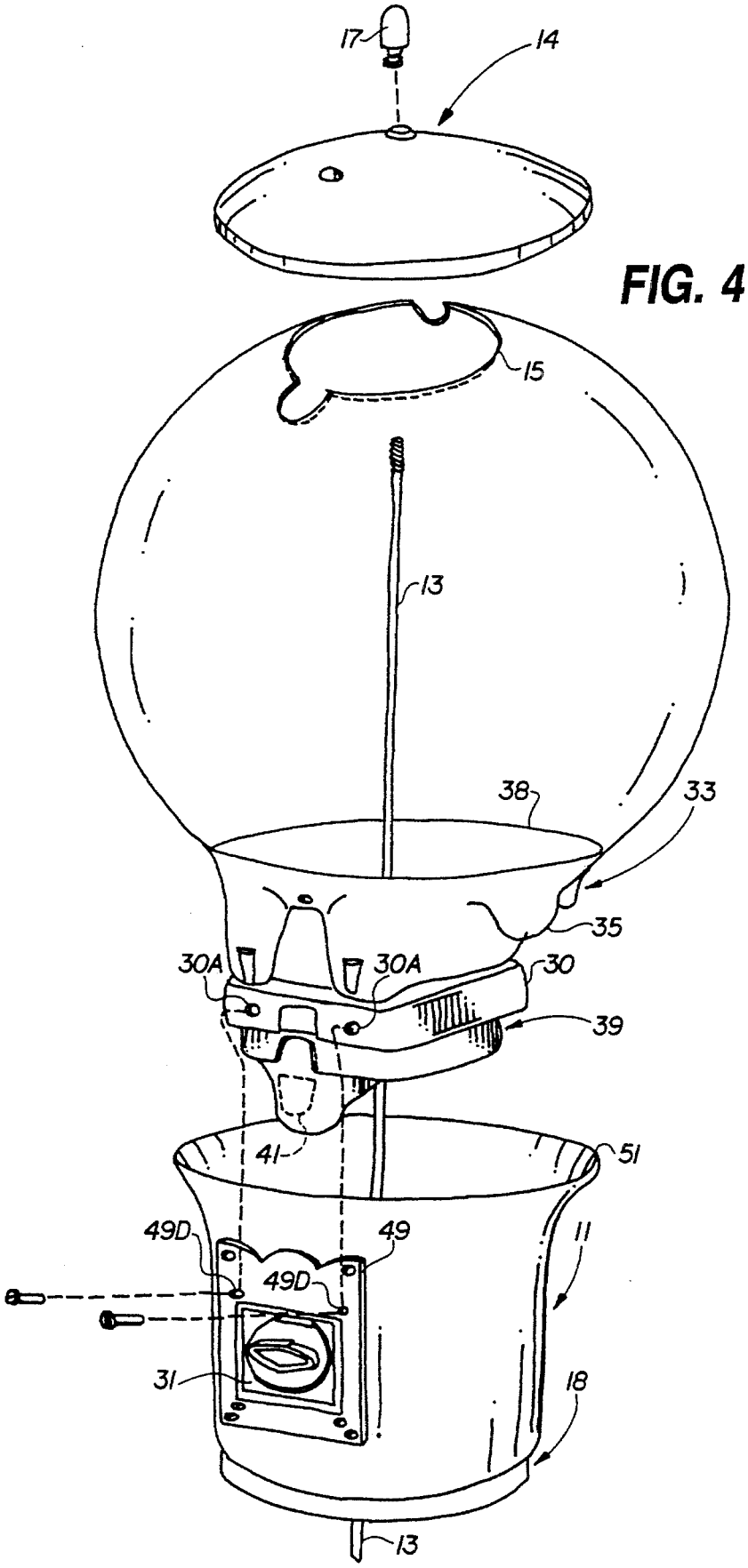
FIG. 4 is an exploded assembly view illustrating certain of the components of FIG. 3 assembled.
Figure 5:
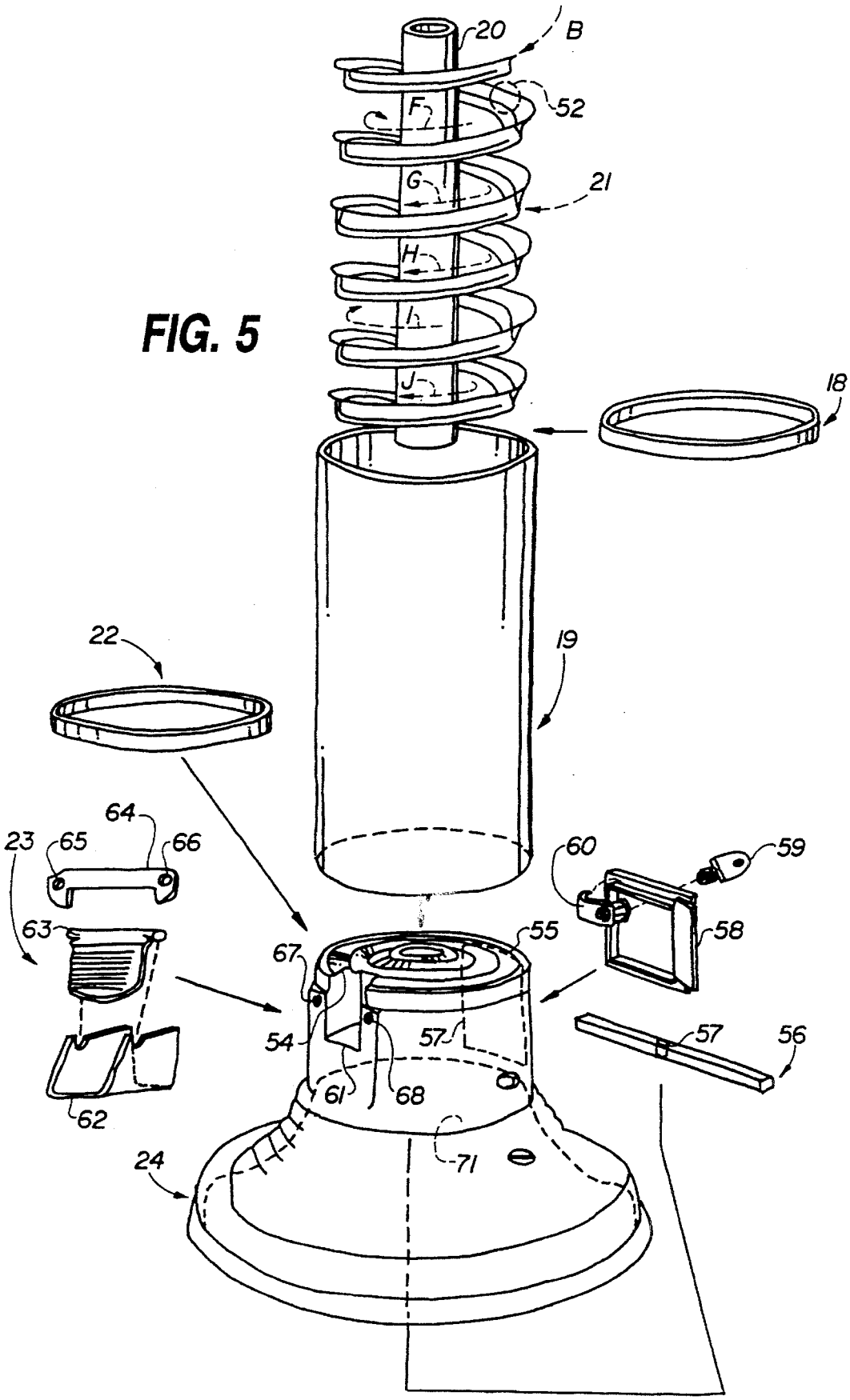
FIG. 5 is an exploded assembly view illustrating certain of the components of the gumball machine of FIG. 1.
Figure 6:
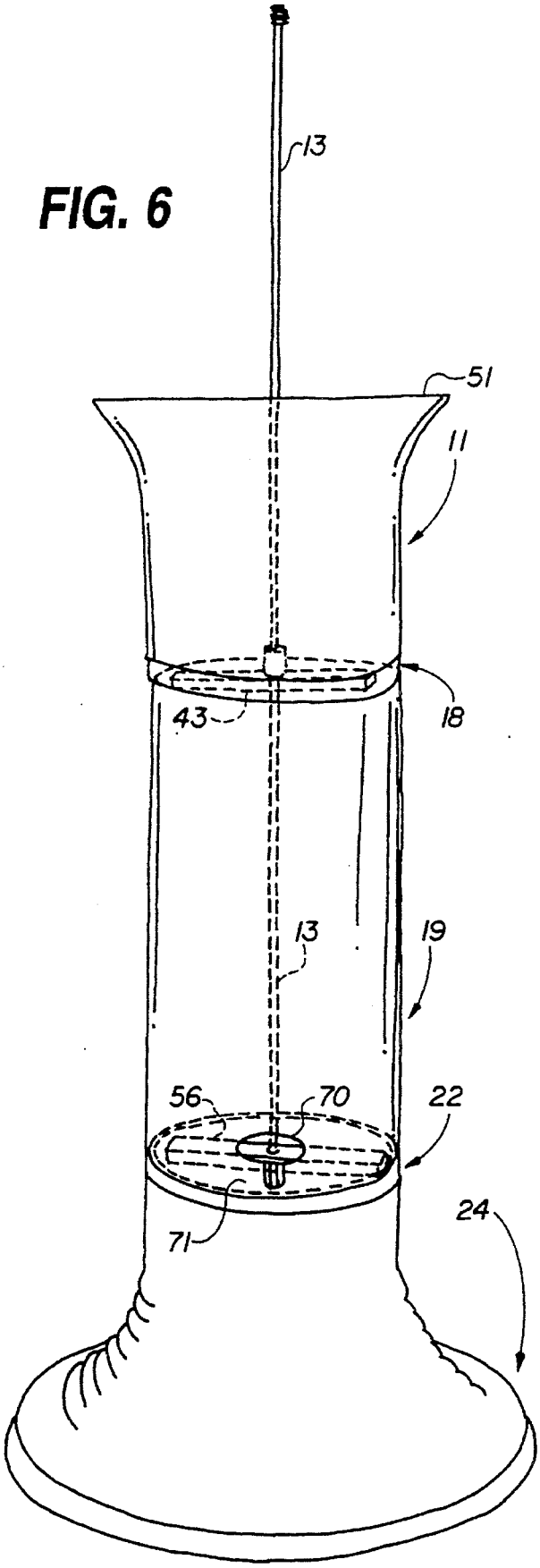
FIG. 6 is an elevation view illustrating certain assembly components of the gumball machine of FIG. 1; and, FIG. 7 illustrates the base of the gumball machine of FIG. 1.

Tension rod 13 extends from base 24, through hollow post 20, through opening 50 in neck 11 (FIG. 3), through aperture 44 in arm 43 inside neck 11, and upwardly through spherical container 10 as illustrated in FIGS. 1, 4, and 6. In FIG. 1, the upper externally threaded end of rod 13 is turned into internally threaded nut 16. Nut 16 is mounted for rotation in cover 14. Key 17 is inserted in nut 16 and is turned to turn nut 16 onto and off of the upper threaded end of rod 13. Cover 14 is sized to extend over and obscure opening 15 formed in the top of container 10. Opening 25 (FIG. 2) is formed in the bottom of container 10. The lower end of rod 13 is also externally threaded and is turned into internally threaded aperture 57 of arm 56 positioned beneath the circular floor 24A of base 24 (FIG. 5).

Tray 33 includes upper circular peripheral edge 38 which seats in the circular upper edge 51 of neck 11. Fingers 9, 34, 36 of tray 33 bear against the inner surface of neck 11 when edge 38 is seated against edge 51. Fingers 9, 34, and 36 help maintain tray 33 in position inside neck 11. When the gumball dispensing mechanism 31 is assembled and the gumball machine of FIG. 1 is assembled, umbrella 26 is positioned above circular opening 37 formed in tray 33; arm 28A extends upwardly through opening 37; screw 26A threads into opening 28B formed in arm 28A; collar 27 is positioned on top of ribbed wheel 28; circular panel 29 is seated on the bottom of cylindrical opening 30A such that slot 40 is aligned with slot 40A formed through the bottom of casing 30; ribbed wheel 28 is seated inside opening 30A on top of panel 29; and, hollow member 39 is attached to the bottom of casing 30 such that a gumball falling downwardly through an opening 28C, opening 40, and opening 40A falls into member 39 and rolls out of member 39 through opening 41 formed therein.

The manually operated mechanism 31 includes a handle 31B which is turned when a coin is inserted in slot 31C. When handle 31B is turned, the fingers of sprocket 31A turn. When the fingers of sprocket 31A turn, the fingers engage and turn the ribs on wheel 28 to rotate wheel 28. When wheel 28 is turned, one of the apertures 28C extending through wheel 28 aligns with openings 40 and 40A such that a gumball setting on top of wheel 28 falls downwardly through the aligned aperture 28C and openings 40 and 40A.

FIG. 3 illustrates container 10 and tray 33 after they are assembled and also illustrates casing 30 attached to the bottom of tray 33 such that opening 30A and 37 are aligned. Although not visible in FIG. 3, umbrella 26, collar 27, ribbed wheel 28, and circular panel 29 are mounted on casing 30. Finally, in FIG. 3, hollow member 39 is attached to the bottom of casing 30.

Before the container 10-tray 33-casing 30-member 39 assembly of FIG. 3 is lowered onto neck 11, the base 24, spiral 21, body 19, post 20, neck 11, and rod 13 are assembled as follows. The lower end of post 20 is centered on and placed on the circular upper surface 55 (FIG. 5) of base 24. The lower end of spiral 21 is placed and centered on surface 55 of base 24 such that a gum ball rolling off of the lower end of spiral 21 rolls onto surface 55 and into opening 54. Spiral 24 is concentric with post 20. The lower end of transparent cylinder 19 slides a short distance over the circular peripheral outer edge of surface 55 and is compressed against base 24 by band 22. Cylinder 22 is concentric with post 20 and spiral 24. The bottom of neck 11 is then placed on top of post 20, spiral 21, and cylinder 22. The upper end of transparent cylinder 19 slides a short distance over the circular peripheral outer edge of the bottom of neck 11 and is compressed against neck 11 by band 18. The upper end of post 22 is aligned with opening 50. Tension rod 13 is then utilized to compress together neck 11, cylinder 19 and base 24 in the manner illustrated in FIG. 6.

In FIG. 6, arm 43 is positioned inside the bottom 11A (FIG. 3) of neck 11. Rod 13 slidably extends through aperture 44 of arm 43. The portion of rod 13 above and extending through aperture 44 is externally threaded. Aperture 44 is cylindrical and is not internally threaded. After the lower end of rod 13 is threaded into internally threaded aperture 57 of arm 56 and rod 13 is slid through aperture 44 of arm 43, a nut is threaded downwardly over the portion of rod 13 just above arm 43 until the nut presses against arm 43 and forces arm 43 against the bottom of neck 11. Tightening the nut against arm 43 also functions to pull arm 56 upwardly against the circular floor 71 of base 24 and to compress together neck 11, cylinder 19, and base 24. In FIG. 6, post 20 and spiral 21 are omitted for the sake of clarity.

After rod 13 is installed in the manner shown in FIG. 6, opening 40A of track assembly 40 is slid down over rod 13 until track assembly 40 seats in the bottom of neck 11 and nose 40A extends into aperture 50. After the track assembly 40 is placed in the bottom 11A of neck 11, the container 10-tray 33-casing 30-member 39 assembly of FIG. 3 is lowered onto neck 11 such that edge 38 seats on edge 51 of neck 11 in the manner shown in FIG. 1. Cover 14 is placed over opening 15 and key 17 is used to tighten nut 16 onto the upper end of rod 13 to press cover 14 against container 10.

Track assembly 40 is oriented inside neck 11 such that after the container 10-tray 33-casing 30-member 39 assembly is seated on edge 51 of neck 11, a gumball rolling out of opening 41 of hollow member 39 rolls onto track assembly 40 and rolls along a spiral path on assembly 40 in the directions indicated by arrows A and B in FIG. 3. Further, track assembly 40 is positioned in the bottom of neck 11 such that a gumball 52 rolling off of track assembly 40 through opening 20 in the direction of arrow B rolls onto the upper end of spiral 21 in the manner shown in FIG. 1 and continues to roll down spiral 21 in the manner shown in FIG. 5 until the gumball 52 reaches surface 55 of bottom 24 and rolls into opening 54. When the gumball rolls into opening 54, it falls into the dispensing cup 62. Door 63 is pivotally attached to cup 62 such that door 63 can be lifted to remove the gumball from cup 62. Cup 62 slides into collar 64 (FIG. 5). Cup 62 also slides into opening 61 in base 24 and is secured in base 24 by screws passing through aperture pairs 65-67 and 66-68.

An access door is secured in rectangular aperture 57 formed in the upper cylindrical wall of base 24. The access door includes a flap 58 and locking flap 60 turned by key 59. Flap 58 is inserted on one side of aperture 57 inside base 24 and permits the access door to be pivoted shut. Once shut, the door is locked by turning locking flap 60 to the position shown in FIG. 5. The locking access door is used because coins inserted in the dispensing mechanism 31 fall onto track assembly 40, slide down over assembly 40 and through nose 40A and fall through aperture 50 and hollow post 20 to the floor 71 of base 24. The access door is removed to access coinage on floor 71.

After the container 10-tray 33-casing 30-member 39 assembly of FIG. 3 is seated on edge 51 of neck 11 in the manner shown in FIG. 1, the mechanism 31 is secured to neck 11 as follows. As shown in FIG. 3, mechanism 31 slides into plate 48. Plate 48 is attached to plate 49 with screws which extend through aligned aperture pairs 49A-48A. Handle 31B extends outwardly through opening 49C in plate 49. Plate 49 is secured to neck 11 with screws which extend through aligned aperture pairs 49B-46 and 49A-47.

When assembled, umbrella 26, collar 27, wheel 28, panel 29, casing 30, and mechanism 31 comprise a conventional gumball dispensing mechanism manufactured by Oak Manufacturing of 2120 E. 25th St, Vernon, Calif. 90058. The umbrella 26 functions to prevent the gumballs above umbrella 26 in container 10 from developing excessive downward pressure against gumballs contacting wheel 28.

Figure 7:
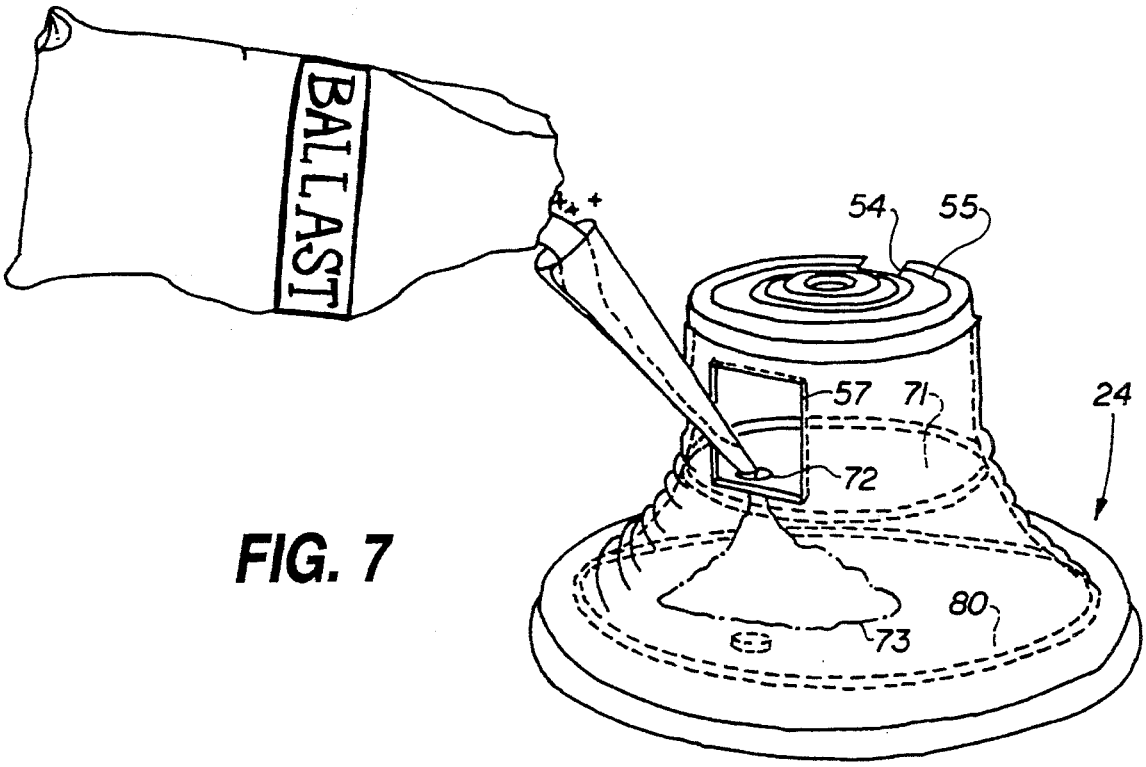

In FIG. 7, ballast 73 is poured through apertures 57 and 72 onto the bottom floor 80 of base 24.

In use of the assembled gumball machine of FIG. 1, the container 10 is filled by removing cover 14 and pouring gumballs through opening 15. The cover 14 is reattached to rod 13. A user places a coin in slot 31C and turns handle 31B. Turning handle 31B causes an opening 28C to align with openings 40 and 40A. Openings 28C, 40, 40A are larger than the gumballs in container 10. When openings 28C, 40, 40A are aligned, a gumball falls downwardly through these three aligned openings under gravity, falls into member 39, rolls through opening 41, rolls along the spiral path of tray 40 in the directions of arrows A and B, rolls out of opening 20 in the direction of arrow B onto the upper end of spiral track 21, rolls down the spiral track in a spiral path in the directions indicated by arrows F to J in FIG. 5, rolls off of track 21 and over surface 55 into opening 54, and falls into cup 62. As the gumball rolls down track 21, it alternately moves in opposing directions as viewed by the user, i.e., the gumball moves from right to left, then left to right, then right to left, etc. as it moves down the spiral track 21.

A gumball presently cannot be seen while it passes through the gumball dispensing mechanism and neck 11 onto spiral track 21. The dispensing mechanism and neck can, if desired, be made of transparent materials so the user can watch a gumball during all or nearly all of its descent from container 10 to base 24.

When there are different colored gumballs in container 10, the purchase of a gumball can be made into a game by seeing if a youngster can identify the color of the gumball while it rolls down track 21.

A zig-zag or Z-shaped track or track of any other shape and dimension can be utilized in place of or in addition to spiral track 21. The track can permit a gumball to roll up as well as down or to fall straight down for selected distances before falling on and beginning to roll again on the track.

The gumball machine of the invention has been found to be effective in attracting potentional customers who enjoy watching a gumball roll down spiral track 21. Since youngsters and adults alike enjoy purchasing gumballs from the machine of the invention, they are put in an improved frame of mind which is believed to encourage the purchase of additional goods from surrounding stores.

Having described my invention in such terms as to enable those skilled in the art to understand and practice it, and having described the presently preferred embodiments thereof, I claim:

1. A gumball machine including (a) a container for storing gumballs;

(b) a base positioned beneath said container;

(c) a vertically oriented hollow tube extending between said container and said base;

(d) a spiral track intermediate said base and said container for permitting a gumball from said container to roll downwardly under gravity along said spiral track around and spaced apart from said vertically oriented hollow tube from said container toward said base, said track having an upper end and a lower end;

(e) a transparent cylindrical transport housing enclosing said track and said vertically oriented hollow tube and permitting a user to visually observe at least a portion of the travel of a gumball while the gumball rolls along said track from said container toward said base; and, (f) a dispensing mechanism operatively associated with said track and actuable to deposit a gumball from said container in said upper end of said track to roll along said track under gravity toward said base.

2. A gumball machine including (a) a container for storing gumballs;

(b) a base positioned beneath said container;

(c) a vertically oriented hollow tube extending between said container and said base;

(d) a track intermediate said base and said container for permitting a gumball from said container to roll downwardly under gravity along said track from said container toward said base, said track having an upper end and a lower end;

(e) a housing enclosing said track and said vertically oriented hollow tube, extending from said container to said base;

(f) tensioned rod means extending from said container, through said hollow tube, and to said base to compress said housing intermediate said container and said base; and, (g) a dispensing mechanism operatively associated with said track and actuable to deposit a gumball from said container in said upper end of said track to roll along said track under gravity toward said base.

3. The gumball machine of claim 2 wherein said track has a spiral shape and a gumball from said container rolls along said track under gravity and around said vertically oriented hollow tube.

4. The gumball machine of claim 3 wherein said housing is cylindrical and transparent and permits a user to visually observe the travel of a gumball while the gumball rolls along the said track from said container toward said base.

5. A gumball machine including (a) a container for storing gumballs;

(b) a base positioned beneath said container;

(c) a vertically oriented hollow tube extending between said container and said base;

(d) a track intermediate said base and said container for permitting a gumball from said container to roll downwardly under gravity along said track from said container toward said base, said track having an upper end and a lower end;

(e) a housing enclosing said track and said vertically oriented hollow tube and extending from said container to said base;

(f) a coin operated dispensing mechanism associated with said track, said container, and said base and operable on the depositing of a coin in said dispensing mechanism to (i) deposit a gumball from said container in said upper end of said track to roll along said track under gravity toward said base; and, (ii) discharge the coin into said hollow tube to travel through said tube to said base.

6. The gumball machine of claim 5 wherein said hollow tube is shaped and dimensioned such that the coin free falls through said tube while traveling to said base.

7. A gumball machine including (a) a container for storing gumballs;

(b) a base positioned beneath said container;

(c) a spiral track intermediate said base and said container for permitting a gumball from said container to roll downwardly under gravity along said spiral track around a vertically oriented axis from said container toward said base, said track having an upper end and a lower end;

(d) a transparent housing extending between said container and said base, enclosing said track, and permitting a user to visually observe at least a portion of the travel of a gumball while the gumball rolls along said track from said container toward said base; and, (e) a dispensing mechanism operatively associated with said track and actuable to deposit a gumball from said container in said upper end of said track to roll along said track under gravity toward said base.

8. A gumball machine including (a) a container for storing gumballs;

(b) a base positioned beneath said container;

(c) a vertically oriented hollow tube extending between said container and said base;

(d) a spiral track intermediate said base and said container for permitting a gumball from said container to roll downwardly under gravity along said track from said container around said vertically oriented hollow tube toward said base, said track having an upper end and a lower end;

(e) a housing enclosing said track and extending from said container to said base;

(f) means extending from said container to said base to compress said housing intermediate said container and said base; and, (g) a dispensing mechanism operatively associated with said track and actuable to deposit a gumball from said container in said upper end of said track to roll along said track under gravity toward said base.

9. The gumball machine of claim 8, wherein said housing is cylindrical and transparent and permits a user to visually observe the travel of a gumball while the gumball rolls along said track from said container toward said base.

10. A gumball machine including (a) a container for storing gumballs;

(b) a base;

(c) a vertically oriented hollow tube extending between said container and said base and having a vertically oriented centerline;

(d) a spiral track intermediate said base and said container for permitting a gumball from said container to move under gravity from said container toward said base spaced apart from said tube along said spiral track around a vertically oriented axis in alternating generally horizontally oriented opposing directions, said track having an upper end and a lower end, said vertically oriented axis being generally parallel to said centerline of said hollow tube; and, (e) a dispensing mechanism operatively associated with said track and actuable to deposit a gumball from said container in said upper end of said track to move under gravity toward said base along said track.

11. A gumball machine including (a) a container assembly for storing gumballs;

(b) a base positioned beneath said container assembly;

(c) a spiral track intermediate said base and said container assembly for permitting a gumball from said container assembly to roll downwardly under gravity along said spiral track from said container assembly toward said base, said track having an upper end and a lower end;

(e) a transparent cylindrical transport housing enclosing said track and permitting a user to visually observe at least a portion of the travel of a gumball while the gumball rolls along said track from said container assembly toward said base;

(f) a cup mounted in said base beneath said transparent cylindrical transport housing to receive and store a gumball dispensed by said lower end of said track onto said base, said cup being accessible by a user to remove a gumball stored therein; and, (g) a dispensing mechanism mounted in said container assembly above said transparent housing and operatively associated with said track and actuable to deposit a gumball from said container assembly in said upper end of said track to roll along said track under gravity to said base and into said cup.

12. A gumball machine including (a) a container for storing gumballs;

(b) a base positioned beneath said container;

(c) a vertically oriented tube extending between said container and said base;

(d) a spiral track intermediate said base and said container for permitting a gumball from said container to roll downwardly under gravity along said spiral path around and spaced apart from said vertically oriented tube from said container toward said base, said track having an upper end and a lower end;

(e) a transparent housing enclosing said track and said vertically oriented tube, said tube and said track being shaped and dimensioned such that a user can visually observe from any point of observation around the gumball machine first and second sides of said track, said first side being intermediate said tube and the user and being closest to the user, said tube being intermediate the user and said second side, said second side being said side of said track furthest from the user at said point of observation; and, (f) a dispensing mechanism operatively associated with said track and actuable to deposit a gumball from said container in said upper end of said track to roll along said track under gravity toward said base.

* * * * *